US005417753A

United States Patent [19]

Hutcheson

[11] Patent Number: 5,417,753

[45] Date of Patent: May 23, 1995

[54] PAPERMAKING COMPOSITIONS, PROCESS USING SAME, AND PAPER PRODUCED THEREFROM

[75] Inventor: Gary S. Hutcheson, Macon, Ga.

[73] Assignee: Sequa Chemicals, Inc., Chester, S.C.

[21] Appl. No.: 193,553

[22] Filed: Feb. 8, 1994

Related U.S. Application Data

[62] Division of Ser. No. 748,098, Aug. 21, 1991, Pat. No. 5,296,024.

[51] Int. Cl.[6] ..... C09D 101/02; C09D 7/12

[52] U.S. Cl. ..... 106/199; 106/179; 106/203; 106/243; 252/8.8; 162/152; 162/158

[58] Field of Search ..... 106/199, 179, 203, 243; 252/8.8; 162/152, 158

[56] References Cited

U.S. PATENT DOCUMENTS

| | | | |
|---|---|---|---|
| 2,142,986 | 1/1939 | Arnold, Jr. | 162/172 |
| 2,772,967 | 12/1956 | Padbury et al. | 162/179 |
| 2,932,602 | 4/1960 | Holgersson et al. | 162/158 |
| 3,014,836 | 12/1961 | Proctor, Jr. | 162/181.8 |
| 3,096,232 | 7/1963 | Chapman | 162/172 |
| 3,554,862 | 1/1971 | Hervey et al. | 162/158 |
| 3,554,863 | 1/1971 | Hervey et al. | 162/158 |
| 3,932,210 | 1/1976 | Suzuki et al. | 162/157.7 |
| 4,032,473 | 6/1977 | Berg et al. | 252/358 |
| 4,075,028 | 2/1978 | Amosov et al. | 162/186 |
| 4,225,456 | 9/1980 | Schmidt et al. | 252/321 |
| 4,458,080 | 5/1984 | Boeharke et al. | 162/158 |
| 4,786,367 | 11/1988 | Bogart et al. | 162/158 |
| 4,786,439 | 11/1988 | Pioog et al. | 252/544 |
| 4,806,167 | 2/1989 | Raythatha | 106/465 |
| 4,826,536 | 5/1989 | Raythatha et al. | 106/465 |
| 4,857,126 | 8/1989 | Söremark et al. | 156/205 |
| 4,877,539 | 10/1989 | Pioog | 252/8.8 |
| 4,923,566 | 5/1990 | Shawki et al. | 162/135 |
| 5,062,922 | 11/1991 | Nakajima et al. | 162/158 |
| 5,143,582 | 9/1992 | Arkens et al. | 162/135 |

FOREIGN PATENT DOCUMENTS

| | | | |
|---|---|---|---|
| 2314060 | 3/1973 | Germany | 162/158 |
| 58-87398 | 5/1983 | Japan | 162/158 |

*Primary Examiner*—David Brunsman
*Attorney, Agent, or Firm*—Mitchell D. Bittman

[57] ABSTRACT

A chemical composition for use in the papermaking process to produce a paper having enhanced characteristics of brightness, opaqueness, and sizing is provided. The process using the composition to make the paper and the paper made therefrom are also provided by the present invention. The composition employs a cationic softener base, such as the mono- and distearamides of aminoethylethanolamine, to enhance sizing, opacity and brightness. A surfactant, such as an ethoxylated tallow amine or the reaction product of a saccharide and an acid, is used to ensure that the components of the composition remain dispersed therein and that the composition achieves uniform dispersibility on the paper. Another embodiment combines an amphoteric softener, such as a salt of an amphoteric stearic acid derivative, the cationic softener base, an acid, such as acetic acid, a surfactant, such as POE (15) tallow amine, carbamide, and water. To speed the production of the composition, a viscosity controlling agent, such as sodium chloride or sodium acetate, may be added thereto. The composition is added to pulp slurry during the papermaking process, and a paper made therefrom exhibits excellent qualities of brightness, opaqueness, water repellency and dispersibility.

20 Claims, No Drawings

PAPERMAKING COMPOSITIONS, PROCESS USING SAME, AND PAPER PRODUCED THEREFROM

This is a division of application Ser. No. 07/748098, filed Aug. 21, 1991, now U.S. Pat. No. 5,296,02.

FIELD OF THE INVENTION

This invention relates to compositions for use in the papermaking process, a papermaking process employing the compositions to add opaqueness, brightness, and sizing to the paper, and a paper produced using the compositions.

BACKGROUND OF THE INVENTION

The quality of paper is often judged by its brightness, opacity, and sizing (or water repellency). Paper producers have long sought to improve these vital characteristics so that an enhanced paper may be obtained.

These three desired characteristics have been obtained in the past by supplying the slurry or furnish with additives prior to the slurry entering the papermaking machine. Various additives are well known in the art. For example, titanium dioxide powder is known to be an excellent whitener. Titanium dioxide, however, is among the most expensive materials that may be added to the slurry. Thus, despite the effectiveness of such material as a brightener, its use is limited and satisfactory replacements have been needed.

Kaolin clay has also been used as a filler in paper to improve brightness in the ultimate product. Generally, the kaolin clay is calcined and then suspended in an aqueous solution prior to being added to the furnish. The clay must be continuously agitated prior to entering the slurry or the solid particles begin to form sediment at the bottoms of the clay holding tanks. Although kaolin clay provides brightness, as well as opacity to the finished paper product, the relative difficulty of adding it to the slurry results in a less than excellent additive.

Furthermore, when clay is added to the slurry, the slurry becomes thicker, thus resulting in a slurry having a higher coefficient of friction. The papermaking process using a kaolin-containing slurry therein increases the processing time relative to the time required for processing a pulp slurry not containing kaolin. Moreover, because the kaolin particles are solids and never completely dissolve in the aqueous solutions, the clay tends to clog or foul the mesh of the wire or fabric on the Fourdrinier or other papermaking machine, thereby resulting in a large amount of down time for cleaning the wire or fabric of the machine. Such kaolin-containing products are described in U.S. Pat. Nos. 3,014,836 to Proctor, Jr. and 4,826,536 to Raythatha et al.

Hydrated aluminum silicate has also been employed as a clay substitute in the papermaking process. It has properties similar to kaolin clay and, thus, results in the same disadvantages when used to make paper.

Many compositions have been added to the slurry in an attempt to size the paper, i.e., add body to the paper and render the paper water repellent or waterproof. Most known sizes, such as those disclosed in U.S. Pat. No. 2,142,986 to Arnold, Jr. and U.S. Pat. No. 3,096,232 to Chapman, employ a type of wax. For example, Arnold, Jr. discloses that an emulsion of wax in a solution of deacetylated chitin, paraffin waxes, Japan wax, carnauba wax, higher aliphatic alcohols, or synthetic waxes may be employed as the waterproofing agent in a sizing composition. A softening agent such as aliphatic alcohols containing 12 to 20 carbons is also present in the composition of Arnold, Jr. Chapman discloses the use of paraffin waxes or water-insoluble derivatives of resins for producing aqueous wax emulsions with cationic modified starches.

U.S. Pat. No. 2,772,967 to Padbury shows a paper sized by adding thereto a salt of a high molecular weight composition prepared by reacting a dialkanolamine or trialkanolamine with a long chain fatty acid. The salt is diluted with water to form a dispersion containing a 5% concentration of sizing agent before being applied to the cellulosic fibers. Apparently, such a dilution of strength was necessary heretofore because until the present invention, preparation of the stearamides which would allow the composition to remain pourable at concentrations greater than 5% was unknown. Without the ability to remain in an emulsion and, hence, be poured, concentrations of stearamides approaching those disclosed herein have not been possible for use on pulp fibers. An important feature also disclosed by the patent is that the salts are cationic and are, therefore, adsorbed by the anionic cellulosic fibers.

Numerous sizing agents are known. Generally, the known sizes are cationic materials, particularly those used to size fabrics for the textile industry. Although the sizes' cationic nature increases their absorption by the fibers to which they are applied, their cationic nature generally prevents them from being used to the full extent possible in connection with a brightener and opacifying agent. It is well known in the art that although cationic materials often increase sizing, they reduce the brightness of the material to which they are applied. Although this is not generally a problem in the textile industry where sizing is important but opaqueness and brightness may be sacrificed, the use of cationic sizes in the paper industry reduces the quality of the paper made therefrom. Because the addition of cationic sizing agents to paper generally reduces the brightness thereof, cationic sizes have not been heretofore preferred as a size for paper, and in particular, as a size for paper made from recycled pulp which often lacks the inherent brightness of paper made from virgin pulp.

Although the prior art shows agents for sizing paper and agents for increasing the brightness and opaqueness of paper, the particular features of the present invention are absent from prior art. The prior art is generally deficient in affording a composition for use in a papermaking process that has the ability to provide sizing to paper without reducing brightness or opacity. Furthermore, the prior art brighteners and opacifying agents fail to allow continuous running of papermaking machines due to the fouling tendency of the forming fabrics. The present invention, however, overcomes the shortcomings of the prior art in that a composition is disclosed herein for simultaneously increasing the brightness, opacity, and sizing of paper made from a slurry containing the composition.

SUMMARY OF THE INVENTION

It is an object of the present invention to provide a composition for adding to paper during the papermaking process so that the resulting paper has enhanced characteristics.

It is another object of the present invention to provide a composition that adds brightness, opacity and sizing to paper to which it is added.

Still another object of the present invention is to provide a composition for adding to the slurry from which paper is formed wherein brightness and opacity of the paper is not sacrificed in favor of sizing.

Another object of the present invention is to provide a composition for brightening, opacifying and sizing a paper which achieves substantially uniform dispersibility on said paper.

Still another object of the present invention is to provide a method for adding a composition to the papermaking process to result in a paper having desirable physical characteristics.

Still another object of the present invention is to provide a process wherein a composition is added to recycled pulp to form a paper having desirable physical characteristics.

Still another object of the present invention is to provide a process for adding a composition to pulp slurry in the papermaking process that will result in a paper having enhanced brightness, opacity, and sizing.

Yet another object of the present invention is to provide a paper having the desirable characteristics of brightness, opacity, and sizing.

Still another object of the present invention is to provide a paper to which a composition has been added during the papermaking process to give the paper enhanced sizing, brightness, and opacity.

Generally speaking, the present invention is directed to a composition used as an additive to the slurry from which paper is formed, the process of making paper from the additive-containing slurry, and the paper made according to that process. The composition is an emulsion of cationic softener base in water. A dispersion aiding component, or surfactant, reduces the surface tension of the composition such that adequate emulsification of the composition's components may occur. The surfactant also ensures that the composition achieves substantially uniform dispersion within the slurry to which it is added and, therefore, uniform dispersion on the final paper product. A viscosity controlling agent may be added to the composition as necessary or desired.

The composition is added to the pulp slurry after the pulp has been bleached to remove lignin and other undesirables and de-inked, if recycled paper pulp is being used, but before the pulp enters into the headbox of a papermaking machine. The composition may be added alone, or in conjunction with other brighteners, opacifying agents, and sizes. For example, in one embodiment of the invention, the composition hereof may be added in conjunction with papermaking clays such as kaolin.

The composition may be added to any pulp slurry to obtain the desired physical characteristics and is especially useful for enhancing the characteristics of paper made from recycled pulp. The amount of composition, as well as the amounts of each component in the composition, will vary depending on the characteristics and types of pulp slurry to which the composition is added. As is well known, different sources of pulp have different peculiarities that attribute to their ability to be brightened, made more opaque and more water resistant, and easily processed. For instance, some pulp requires a higher concentration of brightening and opacifying agents than others to produce a finished paper product having identical characteristics.

The cationic softener base employed in the present invention includes the mono- and distearamides of aminoethylethanolamine and mixtures thereof. The stearamides are sufficient in themselves to provide the desired characteristics when paper is made therefrom, however, as explained below, other components may be added to the composition to increase the desired characteristics.

In making the composition, a long chain fatty acid having between 12 and 18 carbons such as stearic acid is reacted with an alkanoldiamine to form the mono- and di-substituted fatty acid amides of alkanoldiamines. The formation of the amides takes place at a high temperature, preferably about 392° F. (200° C.). The cationic softener base is then allowed to cool to about 200° F. (93° C.). The other components of the composition, such as the surfactant, viscosity controlling agent, if desired, and the water, are preheated to about 190° F. (88° C.). The cationic softener base is then added to these preheated components and the composition is vigorously agitated for about one hour so that the fatty acid amides are substantially dispersed within the emulsion. Furthermore, a viscosity controlling agent may be added to the composition as necessary or desired. The composition is then added to pulp slurry and paper having the desired characteristics of brightness, opacity, and water repellency is produced therefrom. The homogenizing/agitation process insures that the fatty acid amides are reduced to a small particle size so that substantial uniformity of dispersion within the pulp slurry is achieved.

The composition of the present invention may employ an amphoteric softener as an additional brightening agent in addition to the cationic softener base. In this embodiment the composition contains an acid such as acetic acid to completely dissolve the cationic softener and maintain the pH of the composition between about 4 and about 5, a surfactant to ensure adequate dispersion, a carbamide, and water.

The amphoteric softener is a fatty acid amphoglycinate, such as sodium stearoamphoglycinate. In making this present embodiment, the amphoteric softener and cationic softener base are charged to a mixing tank along with a surfactant and water. The components are heated to between about 196° C. and 204° C. and agitated until all the solid components are melted and homogeneously dispersed. Thereupon, the acid is added and agitation continued. A viscosity controlling agent may be added to reduce the viscosity of the mixture. The composition is then cooled with water. After sufficient cooling, urea is added and agitation continued until all the urea is dissolved. The composition is then added to pulp slurry and paper is produced therefrom.

In a further embodiment of the present composition, the reaction product of a saccharide, such as a sucrose derivative, and an acid may replace the amphoteric softener, surfactant, and urea in the embodiment described above. In this embodiment, sucrose is reacted with an acid to form a product that provides added brightness and sizing to the paper made utilizing the composition. This reaction product also acts as the surfactant in this embodiment by lowering the surface tension of the composition and allowing the components thereof to remain in an emulsion.

The paper obtained from the papermaking process employing a slurry containing the present inventive composition exhibits excellent brightness, opacity, and sizing characteristics. Unlike prior art papermaking additives that employ cationic components, brightness and opacity of paper made with the claimed composition are not sacrificed in favor of sizing.

DESCRIPTION OF PREFERRED EMBODIMENTS

A composition for use in the papermaking process such that opaqueness, brightness, and sizing is added to the paper, a papermaking process employing same, and a paper produced from same are provided. Generically, this composition comprises a cationic softener base, a dispersion-aiding component, or surfactant, and water. Another embodiment of this composition comprises an amphoteric softener, a cationic softener base, an acid for controlling pH, a surfactant, carbamide, and water. In a further embodiment of the composition, the amphoteric softener, urea, and surfactant may be eliminated and replaced by a saccharide brightening and sizing agent. Additionally, a viscosity controlling agent may be employed as necessary or desired to aid in production of any of the particular embodiments of the composition.

The composition is added to a pulp slurry after the pulp has been bleached but before the pulp enters into the headbox of a papermaking machine. The composition may be added alone, or in conjunction with other brighteners, opacifying agents, sizes and additives employed in the papermaking process.

The type of pulp slurry to which the composition may be added is unimportant. In fact, the make-up of the composition may be varied depending on the type of cellulosic fibers from which the pulp slurry is made. For instance, if the pulp is inherently dark and requires more brightening, the amount of amphoteric softener or saccharide in the composition may be increased to add brightness to the paper. On the other hand, if the paper produced from the pulp lacks a sufficient degree of water repellency, the amount of cationic softener base or the saccharide may be increased to improve sizing. To increase opaqueness, additional amounts of the cationic softener base and/or the carbamide may be employed. In addition, the use of pulp which has been recycled from papers may require other adjustments to the composition, particularly when the recycled pulp is dark or otherwise discolored. All such adjustments to the composition may be easily made by one of ordinary skill in the art according to the invention disclosed herein.

The pulp to which the composition is added is made into a slurry using conventional techniques. After formation, the slurry is stored in holding tanks or fed to a papermaking machine, such as a Fourdrinier machine, in a conventional manner. The pulp may be bleached to remove unwanted pollutants such as lignins and deinked if pulp made from recycled paper is used. The papermaking composition disclosed herein may be added either to the slurry when it is in the holding tank or may be added to the slurry as it moves along to the headbox of the papermaking machine. Preferably, the composition is sprayed onto the flowing pulp as it travels to the headbox.

When the slurry containing the composition reaches the headbox of the papermaking machine, paper is formed therefrom using conventional papermaking techniques and materials. The paper produced according to the present invention exhibits excellent characteristics of opaqueness, brightness, and opacity.

Moreover, the addition of the composition to the pulp slurry does not cause substantial negative effects on the slurry's movement through the papermaking process and, in fact, actually decreases the coefficient of friction for the slurries to which it is added. Slurries having higher coefficients of friction result in increased drag in the meshes and pulp flow, thus hindering the speed of the papermaking process. Slurries to which clays have been added usually have high coefficients of friction and, as a result, can only run at lower speeds.

In a further embodiment of the present invention, other materials may be added in conjunction with the composition. For instance, kaolin clay may be added in addition to the inventive composition so that the paper made therefrom exhibits increased opaqueness. Other additives which are well known in the art may also be added in conjunction with the composition disclosed herein.

The inventive composition disclosed herein generally comprises a cationic softener base as brightener, opacifier and size, a surfactant, and may include the viscosity controlling agent described below. Although the preferred cationic softener bases employed in the present invention include the mono- and distearamides of aminoethanolamines and mixtures thereof, any of the fatty acid amides may be used and the cationic softener is not limited to the stearic acid amides. Aminoethanolamines available include aminoethylethanolamine, aminobutylethanolamine, aminomethylethanolamine, and the other alkylsubstituted aminoethanolamines. The preferred stearamide derivatives are aminoethylethanolamine monostearylamide and aminoethylethanolamine distearylamide which are mono- and disubstituted fatty acid amides of alkanoldiamines. Other cationic softener bases such as derivatives of imidazole, and in particular imidazoline, may also be used in the present composition.

The preferred cationic softener bases have the general formula

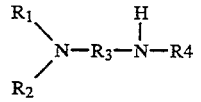

wherein $R_1$ represents a

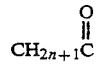

group wherein n is a number from 11 to 17, wherein $R_2$ represents either a

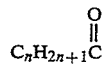

group wherein n is a number from 11 to 17 or a hydrogen, wherein $R_3$ represents an alkyl group, and wherein $R_4$ represents an aliphatic alcohol. Compounds according to this general formula are the reaction products formed from fatty acids and diamines, and, more specifically, are the reaction products of fatty acids and alkanoldiamines (diamine aliphatic alcohols). The chosen fatty acid and chosen alkanoldiamine are mixed and heated at temperatures of 160–200° C. to produce the monostearamides, distearamides, and mixtures thereof. The most preferred cationic softener bases have the formulas $C_{17}H_{35}CONHCH_2CH_2NHCH_2CH_2OH$ and $(C_{17}H_{35}CO)_2NCH_2CH_2NHCH_2CH_2OH$ which represent the mono- and distearamides of aminoethylethanolamine.

Preferably, the cationic softener base used in the present composition will predominantly consist of di-substituted fatty acid amides, particularly distearamides. Because the di-substituted amides have two fatty acid amide groups as opposed to the monosubstituted amides which have only one fatty acid amide group, the di-substituted amides are more active cationic bases. Particularly, the distearamides show a stronger affinity for the cellulosic fibers to which they are adsorbed.

In addition, it is preferred that the particle size of the cationic softener base be as small as possible. The cationic softener base made according to Example 1 herein is a hard solid substance. In order for the cationic softener to remain in an emulsified state as in the composition described herein, intense agitation and heating is required. Moreover, it is highly desirable that the papers produced according to the present invention have substantially uniform brightness, opaqueness, and sizing over its entire surface. Smaller particle sizes aid in the dispersibility of the particles within the slurry so that the desired characteristics are uniform throughout the paper. These smaller particle sizes may be obtained by either homogenizing the product in a high speed mixer or by rapidly cooling the composition from the high temperature at which the cationic softener base is formed as described herein.

A preferred surfactant used in the present invention is an ethoxylated surfactant such as POE (15) tallow amine. The surfactant further contributes to the desired dispersability of the fatty acid amides in the water emulsion. If the amount of surfactant added is excessive, the sizing capability of the composition will be adversely affected. In the absence of a surfactant, the paper may be of a poor quality due to the decreased dispersibility of the composition, which results in spots or specks on the paper indicating a lack of dispersibility.

The amphoteric softener used in making another embodiment of the claimed composition is preferably in salt form to enhance solubility thereof. The amphoteric softeners contribute to the brightening of the paper made with the composition. The amphoteric capability of this component allows for different ionic structures in different environments. As described herein, the amphoteric softener maintains a cationic nature in the acidic environment of the present composition which contributes to the reaction activity of the cationic softener base described below. The amphoteric softener used in the composition preferably is a fatty acid derivative having from 12 to 18 carbons. The salts of stearic acid amphoglycinate derivatives, and particularly sodium stearoamphoglycinate, most advantageously exhibit the preferred qualities of the amphoteric softener component and are also readily available in the marketplace.

A weak acid is preferred to dissolve the solid cationic softener base in the embodiment employing the amphoteric softener. The acid maintains an acidic pH preferably within the range of from about 4 to about 5 during the making of the composition. The acid acts as a catalyst by creating an acidic environment wherein the cationic softener base exhibits increased reactivity and the amphoteric softener, when employed, maintains a cationic nature. Weak organic acids such as acetic acid or formic acid are especially preferred in the composition. Strong acids, of course, may be used to control the pH, but cost and safety considerations may restrict their use.

In this embodiment, a carbamide, preferably urea, contributes to opacity of the paper. Other carbamide derivatives may be used in the invention as long as they dissolve as the composition is being made and do not detract from the opacity of the finished paper.

In another embodiment, the composition employs a saccharide derivative as surfactant, brightener and size. This embodiment contains the previously described cationic softener base but, because the saccharide derivative acts as a surfactant to allow adequate dispersion, the ethoxylated tallow amine may be eliminated. In addition, the carbamide may also be eliminated in this embodiment because the paper to which this embodiment is added may exhibit the desired opacity. When employed, the saccharide component nearly doubles the effective sizing capability of the composition.

Preferably, a viscosity controlling agent such as a salt is added during production of the papermaking composition. Generally, the sodium salts and chloride salts are known viscosity controlling agents. Preferred salts include sodium acetate and sodium chloride. This component may be deleted, but the processing time for creating the composition will be substantially increased.

The present invention may be better understood by reference to the following examples.

EXAMPLE 1

Mono- and distearamides of aminoethylethanolamine are made by reacting stearic acid with aminoethylethanolamine. 1845 grams of stearic acid (65% stearic acid and 35% palmitic acid) and 405 grams of aminoethylethanolamine are charged to a reactor and sparged with nitrogen at a rate of 10 $ft^3$/min. Using slow agitation, the temperature of the reactor is raised to between about 385 and about 400° F. (196°–204° C.) and preferably about 392° F. (200° C.), and held at such a temperature for about 45 minutes. The product is then allowed to cool at room temperature. The liquid weight percentages of the components used in making the stearamides are 82.83% stearic acid and 17.17% aminoethylethanolamine.

EXAMPLE 2

Specifically, a composition of the present invention comprises a cationic softener base, particularly the mono- and distearamides of aminoethylethanolamine made according to Example 1 above, sodium acetate or sodium chloride as a viscosity controlling agent, and a polyoxyethylated surfactant such as the tallow amine previously described. As discussed above, the viscosity controlling agent may be eliminated but processing time will be increased.

A composition of this invention is made by charging 110 grams of the mono- and distearamides and mixtures thereof made according to Example 1 to a mixing chamber equipped with an agitator. The temperature is raised to about 212° F. (100° C.) and agitation is begun until a melt is formed. An emulsion is made by adding water to the mixture and allowing the mixture to cool to between about 180 and about 190° F. (82°–88° C.). Two grams of sodium acetate is then added to thin the mixture. When the temperature drops below about 165° F. (74° C.), and preferably at about 160° F. (71° C.), 2 grams of POE (15) tallow amine (TAM 15 obtained from Henkel Co.) is added to the mixture. The addition of the surfactant aids in keeping the composition in an emulsion. Agitation continues for about 30 minutes while water is metered into the mixing tank to bring the total amount of the water employed in making the composition to about 886 grams. The weight percentages of the components used in the present example are set forth below:

| Component | Dry-Weight Percent of Component |
|---|---|
| Cationic Softener Base (mono- and distearamides of aminoethylethanolamine made in Example 1) | 11.00% |
| Viscosity Controlling Agent (sodium acetate) | 0.20% |
| Surfactant (POE (15) tallow amine) | 0.20% |
| Water | 88.60% |

EXAMPLE 3

A composition of Example 2 was added to a pulp slurry prior to entering a papermaking machine headbox at a rate of about 4 gallons per minute and a paper was formed therefrom. Further testing established that a rate of 2 to 5 gallons per minute, and more specifically, about 2 to 2½ gallons per minute is preferred for adding the composition of Example 2 to the slurry to create a paper having the desired characteristics.

As explained above, the making of stearamides according to Example 1 produces a hard, solid compound. If the preferred dispersibility of the composition is to be obtained, the cationic softener base requires homogenization prior to combining with the other components of the composition. One method of homogenization employs vigorous agitation and heating. Instead of allowing the mono- and distearamides of aminoethylethanolamine to cool to room temperature as described in Example 1, the stearamides are only allowed to cool to about 200° F. (93° C.). The cationic softener is held at this temperature, which is just below the boiling point of the liquid, until it is combined with the other components. The other components of the composition are preheated to about 190° F. (88° C.) and the required amount of cationic softener base is added thereto to comprise the appropriate percentage within the composition. The composition is then held at about 200° F. and vigorously agitated for about one hour. This results in an emulsion having substantially uniform small particle size so that good dispersion of the composition with respect to the pulp slurry is achieved thereby.

Alternatively, the composition may be homogenized to provide the good dispersion characteristics by rapid super cooling of the composition. Using this method, the stearamides are held at a temperature of about 200° F. and then transferred in the appropriate amount to the preheated remaining component mixture. After achieving a temperature of about 200° F., the mixture is rapidly cooled to room temperature by subjecting the mixture to dry ice or other super cooling methods. This results in an emulsion having substantially uniform small particle size throughout. Such super cooling methods may include the use of storage tanks being cooled by circulating freon, but the method of making the present composition is not limited to a particular method of super cooling.

The super cooling of the composition may be employed in addition to the homogenization by agitation described above, or may be used in lieu of such agitation. Examples of creating the preferred homogenous composition follow.

EXAMPLE 4

Mono- and distearamides of aminoethylethanolamine are made generally according to Example 1 above but instead of allowing the product to cool to room temperature, the stearamides are only allowed to cool to about 200° F. (93° C.). The components of the composition in the amounts and percentages described in Example 2 (2 grams of POE (15) tallow amine, 2 grams of sodium acetate, and 886 grams of water) are preheated to about 190° F. (88° C.) in a Shear Hill Mixer manufactured by Hill Manufacturing Company. An amount of the mono- and distearamides of aminoethylethanolamine sufficient to comprise about 11% by dry weight of the final composition (110 grams) is added to the mixer. High-speed agitation is begun and continued at 200° F. for about one hour. The resulting composition achieves the preferred dispersibility with respect to the pulp slurry when added thereto as described in Example 3.

EXAMPLE 5

A composition of the present invention may alternatively be made by employing super-cooling to achieve the desired dispersibility of the composition with respect to the slurry. The mono- and distearamides of aminoethylethanolamine are made generally according to the process of Example 1. Instead of allowing the mixture to cool to room temperature, however, the emulsion is allowed to cool only to about 200° F. (93° C.). The remaining components of the composition, whether they be the surfactant, viscosity controlling agent and water as described in Example 2, the viscosity controlling agent, surfactant, amphoteric softener, water, carbamide, and acid as described in Examples 6 and 7, or sucroseoxyacetate, water, and viscosity controlling agent as described in Example 13 are preheated to about 190° F. The stearamides and other components are then mixed and agitated at about 200° F. for about 10 minutes. After such mixing, the mixing vessel is rapidly cooled using a dry ice pack so that the temperature of the emulsion is reduced to room temperature or below in about 10 minutes or less. This cooling process also results in a composition having the desired dispersion characteristics.

In Examples 6 and 7 wherein an amphoteric softener is employed, the amphoteric softener, viscosity controlling agent, acid, surfactant, carbamide, and water are preheated in the Shear Hill Mixer. The cationic softener base in the required amount is then maintained at a temperature of about 200° F. after creation thereof and is metered into the mixer. Agitation continues at about 200° F. for about one hour to achieve a preferred composition having the desirable characteristics of brightness, opacity, water repellency, and uniform dispersibility throughout the slurry. Likewise, in the embodiments employing a sucroseoxyacetate as described in Example 13, the sucroseoxyacetate, water, and viscosity controlling agent are preheated in the Shear Hill Mixer and the cationic softener base is metered therein at a temperature of about 200° F. Vigorous agitation is maintained at about 200° F. for about one hour to achieve the preferred composition. This mixing process reduces the size of the particles held in the emulsion so that the composition is substantially homogeneous throughout.

As mentioned above, the rapid super-cooling of the mixture may be employed in addition to the one-hour agitation in the mixer as described in Example 4 or may, alternatively, be employed in lieu of such agitation. Preferably, however, the prolonged high-speed agitation of Example 4 will be combined with the rapid super cooling described in Example 5 to achieve the preferred product. It will also be appreciated by those of ordinary skill in the art that other methods and apparatus may be employed to achieve such super cooling. It will also be understood by those of ordinary skill in the art that the super agitation and/or super cooling described in Examples 4 and 5 may be used in producing any of the various embodiments of the present invention to achieve good dispersibility of the composition with respect to the paper made from the slurry.

By employing the processes described in Examples 12 and 13, a method of preparing an emulsion of fatty acid amides of an alkanoldiamine in water where the concentration of fatty acid amides is greater than 5% is provided. As explained earlier, prior art methods of preparing emulsions of fatty acid amides employed in the present composition in water have been limited to concentrations of 5% or less. By providing the fatty acid amides of the alkanoldiamine at a temperature of about 200° F., mixing the fatty acid amides with the liquid serving as an emulsifier until the fatty acid amides are dispersed therein and then rapidly cooling the mixture of fatty acid amides and emulsifier such that the fatty acid amides remain in an emulsified state with respect to the emulsifier results in the ability to provide an emulsion where the fatty acid amides' concentration is greater than 5%. Of course, such rapid cooling processes described in Example 13 may be combined with the super agitation process of Example 12 to provide for even greater percentages of fatty acid amides and emulsion.

EXAMPLE 6

Another embodiment of the papermaking composition of the present invention is prepared as follows. 1075 grams of sodium stearoamphoglycinate, 3400 grams of the mono- and distearamides of aminoethylethanolamine made according to Example 1, 325 grams of POE (15) tallow amine and 9996 grams of water are charged to a mixing tank equipped with an agitator. Heating and agitation are begun, and the mixture is heated to between about 195° and about 205° F. (91°-96° C.) and held at this temperature for approximately one hour. When all the solid components in the mixing tank are melted and homogeneously dispersed, 499 grams of acetic acid is added and agitation is continued for about 15 to 30 minutes. After such agitation, about 100 grams of sodium chloride is added and agitation continued for another 30 minutes. Thereafter, heating is discontinued, cooling water is cycled through the jacket coils surrounding the mixing tank, and 8330 grams of additional water is added to the mixing tank to cool the contents. The temperature of the dispersion is monitored until it reaches 140° F. (60° C.)6000 grams of urea is then added to the mixing tank with cooling and agitation continuing until the temperature of the constituents reaches about 110°-115° F. (42°-46° C.) and all the carbamide dissolved.

The dry weight percentages of the components are shown below:

| Component | Dry Weight Percent of Component |
|---|---|
| Amphoteric Softener (sodium stearoamphoglycinate) | 3.60% |
| Cationic Softener Base (mono- and distearamides of aminoethylethanolamine made in Example 1) | 11.50% |
| Viscosity Controlling Agent (sodium chloride) | 0.34% |
| Acid (acetic acid) | 1.70% |
| Surfactant (POE (15) tallow amine) | 1.10% |
| Carbamide | 20.30% |
| Water | 61.50% |

EXAMPLE 7

The process and components described in Example 6 were employed in making a further embodiment of the inventive composition. In this composition, dry weight percentages used were as follows: amphoteric softener (sodium stearoamphoglycinate) about 1.13%, the cationic softener base (mono- and distearamides of aminoethylethanolamine) about 8.00%, viscosity controlling agent (sodium chloride) about 0.25%, acid (acetic acid) about 0.98%, surfactant (POE (15) tallow amine) about 0.75% weight, carbamide (urea) about 14.00%, and water composed the remaining about 74.89% by weight.

It has also been found through further refining of the composition that the amphoteric softener, preferably sodium stearoamphoglycinate, should be in a range of between about 0.5% to about 4%. The cationic softener base, preferably the mono- and distearamides of aminoethylethanolamine made according to Example 1, should be present in an amount of about 7.5% to about 13%. The viscosity controlling agent should be present in an amount of about 0.25 to about 0.35%. The acid, preferably acetic or formic acid, should be present in an amount at least of about 0.9% so that the pH of the mixture is controlled between about 4 and about 5. The non-ionic surfactant, preferably POE (15) tallow amine, should be present in an amount of at least about 0.20%. The carbamide used in the composition should be within the range of from about 10% to about 25% and the water should be in a range of from about 60% to about 75%.

EXAMPLE 8

The composition made according to Example 6 was added to a pulp slurry as the pulp slurry was transported along a feeding mechanism to the headbox of a Fourdrinier machine. The composition was added at a rate of 3 to 3½ gallons per minute, and paper produced therefrom exhibited the desired characteristics. The coefficient of friction of the slurry after adding the composition was measured and determined to be 0.3.

EXAMPLE 9

The composition made according to the process described above in Example 6 was added to a pulp slurry as the pulp slurry was transported along a feeding mechanism to the headbox of a Fourdrinier machine.

The composition was added at a rate of 2.8 gallons per minute, and paper produced therefrom exhibited the preferred characteristics.

EXAMPLE 10

The composition made according to Example 6 was added to a pulp slurry as it was transported to the headbox at a rate of 5 gallons per minute. The paper produced according to this example showed increased opacity and sizing but a similar brightness compared to the paper produced according to Example 8.

EXAMPLE 11

The composition made according to the process of Example 6 was added to a pulp slurry at a rate of 2 gallons per minute. In addition, a 33% aqueous solution of kaolin clay was added coincidentally with the papermaking additive to the slurry at a rate of 8 gallons per minute and paper was produced therefrom. Although the paper exhibited the desired characteristics, the coefficient of friction of the slurry after adding the composition and the clay was determined to be 0.7.

A 33% aqueous slurry of kaolin clay alone was added to a pulp slurry as it traveled to a Fourdrinier machine so that paper produced therefrom could be compared to paper made with the present invention. To produce paper having brightness characteristics comparable to those exhibited by the paper made according to Example 8, kaolin clay was added to the slurry at a rate of about 12 gallons per minute.

When adding the composition to a pulp slurry as described in Example 8, without the addition of kaolin clay, the Fourdrinier machine exhibited excellent runability, less drag, less power requirements, and overall smoother operation than the machine did when kaolin clay was added to the slurry. These characteristics add to the overall operational printability of the paper made using the present composition.

The coefficient of friction for the pulp slurry without the addition of any kaolin clay or the addition of the inventive composition was also measured. The coefficient for the slurry without any such additives was 0.5. As evidenced by the low coefficient of friction noted in Example 8, addition of the inventive composition to a pulp slurry actually decrease the amount of drag as compared to a papermaking process using a pulp slurry in which no additives are employed.

EXAMPLE 12

Sucroseoxyacetate for use as a component in compositions according to the present invention was made as follows. 600 grams of 84% acetic acid was added to 400 grams of sucrose in a vessel equipped with an agitator as in the preceding examples. The mixture was agitated and heated to about 135°–140° F. (57°–60° C.). Temperature was then held until titrations indicated one gram of reaction mixture dissolved in 100 mls. of water (6.0 to 7.0 mls. of 1.0 M sodium hydroxide to titrate to phenolphthalein endpoint). The resulting sucroseoxyacetate was then allowed to cool for further use.

EXAMPLE 13

An embodiment of the present invention employing a saccharide as a brightener and size is made as follows. 110 grams of the mono- and distearamides and mixtures thereof made according to Example 1 are heated to about 212° F. (100° C.) until a melt thereof is formed. An emulsion is created by adding water to the melt followed by agitation. Two grams of sodium acetate is added to the mixing tank after the emulsion thins and cools to about 180°–190° F. (82°–88° C.). Cooling and agitation are continued until the temperature of the emulsion drops below about 165° F. (74° C.), whereupon 50 grams of the sucroseoxyacetate made according to Example 12 is added to the mixing tank. Agitation continues for about 30 minutes and additional water is metered into the mixing tank so that the total amount of the water added totals about 838 grams.

The weight percentages of the components used in the present example are set forth below:

| Component | Dry Weight Percent of Component |
|---|---|
| Cationic Softener Base (mono- and distearamides of aminoethylethanolamine made in Example 1) | 11.00% |
| Sucroseoxyacetate (made in Example 12) | 5.00% |
| Viscosity Controlling Agent (sodium acetate) | 0.20% |
| Water | 83.80% |

EXAMPLE 14

A composition of Example 13 was added to a pulp slurry prior to entering a papermaking machine headbox at a rate of 3–3.5 gallons per minute and a paper having the desired characteristics was formed therefrom.

EXAMPLE 15

A composition made according to the process of Example 13 was added to a pulp slurry at a rate of about 2½ gallons per minute in addition to a 33% aqueous solution of kaolin clay which was added at a rate of 8 gallons per minute. The paper produced therefrom exhibited the desired characteristics but the slurry had a coefficient of friction of 0.7.

The opacity, brightness and water repellency of the paper produced from the slurry made in Examples 3, 8 and 14 were measured, averaged, and compared to the paper made from a slurry from pulp of a similar source to which no brightening, opaquing, or sizing agents had been added. The results are shown below:

| | Opacity* | Brightness* | Size** |
|---|---|---|---|
| Plain Paper | 90.5–91.0 | 58–59 | instant |
| Paper of Example 3 | 94.5–95.5 | 58–60 | 47 sec. |
| Paper of Example 8 | 94.0–94.5 | 58–59 | 50 sec. |
| Paper of Example 14 | 94.0–94.5 | 60–61 | 90 sec. |

*Opacity and brightness were measured using a Technidyne Technibrite Micro TB-1C. Measurements are given in TAPPI standard

**Sizing was measured using the standard water drop test.

One with skill in the art will appreciate the fact that the rate of adding any of the embodiments of the inventive composition to a pulp slurry will vary depending on the peculiarities of the pulp, the characteristics desired in the paper made therefrom, and the capabilities of the papermaking machine and slurry feeding mechanism. As previously explained, these factors will also influence the exact amounts of each component used in producing the papermaking composition. Testing, however, showed that the preferred rate of adding the composition to achieve optimal characteristics and a low coefficient of friction was between 2 and 5 gallons per minute.

Although preferred embodiments of the invention have been described using specific terms, devices, concentrations, and methods, such description is for illustrative purposes only, and it is to be understood that changes and variations may be made without departing from the spirit or the scope of the following claims.

What is claimed is:

1. Method of producing a paper with enhanced brightness, opaqueness and sizing comprising the steps of:

providing a slurry of cellulose fibers;

adding to said slurry a composition wherein said composition comprises a cationic softener base selected from the group consisting of the reaction products formed from the reaction of fatty acids and diamines and wherein said composition further includes a surfactant; and forming said slurry into said paper.

2. The method as defined in claim 1 wherein said cationic softener base is selected from the group consisting of aminoethylethanolamine monostearylamide, aminoethylethanolamine distearylamide, mixtures of aminoethylethanolamine monostearylamide and aminoethylethanolamine distearylamide, and imidazoline.

3. The method as defined in claim 1 wherein said composition further comprises a viscosity controlling agent.

4. The method as defined in claim 3 wherein said viscosity controlling agent is selected from the group consisting of sodium acetate and sodium chloride and said surfactant is an ethoxylated surfactant.

5. The method as defined in claim 1 wherein said cationic softener base is present in said composition in an amount of at least about 7.5% by weight.

6. The method as defined in claim 5 wherein said surfactant is present in said composition in an amount of at least about 0.20% by weight.

7. The method as defined in claim 1 wherein said composition further comprises an acid; and forming said slurry into paper.

8. The method as defined in claim 7 wherein said cationic softener base is selected from the group consisting of aminoethylethanolamine monostearylamide, aminoethylethanolamine distearylamide, mixtures of aminoethylethanolamine monostearylamide and aminoethylethanolamine distearylamide, and imidazoline, said acid is selected from the group consisting of acetic acid and formic acid, and said surfactant is an ethoxylated surfactant.

9. The method as defined in claim 1 further comprising the step of adding kaolin clay to said slurry.

10. The method as defined in claim 1 wherein said composition is added to said slurry at a rate of from about 2 gallons per minute to about 5 gallons per minute.

11. The method as defined in claim 1 wherein said surfactant in said composition is a product of a reaction between a saccharide and an acid.

12. The method as defined in claim 11 wherein said cationic softener base in said composition is selected from the group consisting of aminoethylethanolamine monostearylamide, aminoethylethanolamine distearylamide, mixtures of aminoethylethanolamine monostearylamide and aminoethylethanolamine distearylamide, and imidazoline and wherein said surfactant is sucroseoxyacetate.

13. A paper product made from cellulose fibers having enhanced brightness, opaqueness and sizing, said product having a composite therein comprising a cationic softener base selected from the group consisting of the reaction products formed from the reaction of fatty acids and alkanoldiamines and wherein said composition further comprises a surfactant.

14. The paper product as defined in claim 13 wherein said surfactant is an ethoxylated surfactant.

15. The paper product as defined in claim 13 wherein said cationic softener base is selected from the group consisting of aminoethylethanolamine monostearylamide, aminoethylethanolamine distearylamide, mixtures of aminoethylethanolamine monostearylamide and aminoethylethanolamine distearylamide, and imidazoline.

16. The paper product as defined in claim 13 wherein said cationic softener base is present in said composite in an amount of at least about 7.5% by weight and said surfactant is present in an amount of at least about 0.20% by weight.

17. The paper product as defined in claim 13 wherein said composite further comprises an acid.

18. The paper product as defined in claim 17 wherein said cationic softener base is selected from the group consisting of aminoethylethanolamine monostearylamide, aminoethylethanolamine distearylamide, mixtures of aminoethylethanolamine monostearylamide and aminoethylethanolamine distearylamide, and imidazoline.

19. The paper product as defined in claim 13 further comprising a viscosity controlling agent.

20. The paper as defined in claim 19 wherein said stearamide derivative is selected from the group consisting of aminoethylethanolamine monostearylamide, aminoethylethanolamine distearylamide, mixtures of aminoethylethanolamine monostearylamide and aminoethylethanolamine distearylamide, and imidazoline, and said viscosity controlling agent is selected from the group consisting of sodium acetate and sodium chloride.

* * * * *

UNITED STATES PATENT AND TRADEMARK OFFICE

CERTIFICATE OF CORRECTION

PATENT NO. : 5,417,753

DATED : May 23, 1995

INVENTOR(S) : Gary S. Hutcheson

It is certified that error appears in the above–identified patent and that said Letters Patent is hereby corrected as shown below:

Col. 6, line 45, change "$CH_{2n+1}\overset{O}{\overset{\|}{C}}$" to

-- $C_nH_{2n+1}\overset{O}{\overset{\|}{C}}$ --

Signed and Sealed this

Twelfth Day of August, 1997

Bruce Lehman

*Attest:*

BRUCE LEHMAN

*Attesting Officer*

*Commissioner of Patents and Trademarks*